US007966777B2

(12) United States Patent
Douglas et al.

(10) Patent No.: US 7,966,777 B2
(45) Date of Patent: Jun. 28, 2011

(54) MECHANICAL LIFT, FULLY NESTING, TELESCOPING MAST

(75) Inventors: Timothy A. Douglas, Park City, UT (US); Daniel C. Kennedy, II, Salt Lake City, UT (US); Randy A. Jones, Park City, UT (US)

(73) Assignee: ITT Manufacturing Enterprises, Inc., Wilimington, DE (US)

( * ) Notice: Subject to any disclaimer, the term of this patent is extended or adjusted under 35 U.S.C. 154(b) by 1769 days.

(21) Appl. No.: 11/165,830

(22) Filed: Jun. 24, 2005

(65) Prior Publication Data

US 2007/0028532 A1 Feb. 8, 2007

Related U.S. Application Data

(60) Provisional application No. 60/583,197, filed on Jun. 25, 2004.

(51) Int. Cl.
*B66C 23/36* (2006.01)

(52) U.S. Cl. ..... 52/118; 52/111; 52/110; 52/121; 52/632

(58) Field of Classification Search ..... 52/121, 52/111, 120, 118, 122.1, 110, 632, 40; 212/296, 212/231, 264; 474/184, 185
See application file for complete search history.

(56) References Cited

U.S. PATENT DOCUMENTS 1,319,943 A 10/1919 Bessolo
2,632,530 A 3/1953 Wagner
2,795,303 A 6/1957 Muehlhause et al.
2,966,956 A * 1/1961 Campbell et al. ..... 182/69.4
3,000,473 A 7/1961 Reynolds
3,328,921 A 7/1967 Keslin
3,638,806 A * 2/1972 Hippach ..... 212/231
3,845,596 A * 11/1974 Veenstra ..... 52/118
3,848,703 A * 11/1974 Rundle ..... 187/226
3,952,467 A * 4/1976 Partlow ..... 52/121
4,166,542 A * 9/1979 Bryan, Jr. ..... 212/231
4,468,904 A * 9/1984 O'Malley ..... 52/111
4,506,480 A * 3/1985 Murrill et al. ..... 52/121
4,580,377 A * 4/1986 Sundin ..... 52/121
4,585,132 A * 4/1986 Rathe et al. ..... 212/349
4,592,474 A * 6/1986 Rathe ..... 212/348
4,600,348 A * 7/1986 Pettit ..... 414/11
4,655,323 A * 4/1987 Bocker ..... 187/226
4,657,112 A * 4/1987 Ream et al. ..... 182/69.4
(Continued)

FOREIGN PATENT DOCUMENTS

DE 3729353 A1 * 3/1988
(Continued)

*Primary Examiner* — Phi Dieu Tran A
(74) *Attorney, Agent, or Firm* — Thorpe North & Western LLP

(57) ABSTRACT

A telescoping mast apparatus has a plurality of nesting cylinders. The telescoping mast apparatus has a plurality of telescoping cylinders and a plurality of straps. The plurality of cylinders is extendable from a base. Each strap extends from near a bottom of an outer cylinder, around an upper roller near a top of the outer cylinder, and is attached near a bottom of an inner cylinder. The plurality of straps and the plurality of telescoping cylinders intercouples in series with alternating straps and cylinders. The plurality of cylinders is extended by retracting a first strap from the outer cylinder, which raises an intermediate cylinder, which retracts the intermediate strap from the intermediate cylinder, which raises the second intermediate cylinder.

19 Claims, 10 Drawing Sheets

U.S. PATENT DOCUMENTS

| | | | | | |
|---|---|---|---|---|---|
| 4,663,900 | A | * | 5/1987 | Rehm et al. | 52/115 |
| 4,683,677 | A | * | 8/1987 | Jurgensen | 49/200 |
| 4,783,934 | A | * | 11/1988 | Langhart et al. | 52/64 |
| 4,932,176 | A | * | 6/1990 | Roberts et al. | 52/118 |
| 5,060,427 | A | * | 10/1991 | Bernabe, Jr. | 52/118 |
| 5,101,215 | A | * | 3/1992 | Creaser, Jr. | 343/883 |
| 5,400,551 | A | * | 3/1995 | Uhl | 52/68 |
| 5,490,364 | A | * | 2/1996 | Desai et al. | 52/637 |
| 5,550,349 | A | * | 8/1996 | Bomba | 219/213 |
| 5,557,892 | A | * | 9/1996 | Lavin | 52/121 |
| 5,718,087 | A | * | 2/1998 | Featherstone et al. | 52/121 |
| 5,786,854 | A | * | 7/1998 | Slade et al. | 348/373 |
| 5,803,204 | A | * | 9/1998 | White et al. | 182/148 |
| 6,041,558 | A | * | 3/2000 | Sylvestre | 52/111 |
| 6,046,706 | A | | 4/2000 | Vargas | |
| 6,494,636 | B1 | * | 12/2002 | Mozena | 403/109.2 |
| 6,928,774 | B1 | * | 8/2005 | Weiss et al. | 52/111 |
| 2008/0236060 | A1 | * | 10/2008 | Battaglia | 52/121 |

FOREIGN PATENT DOCUMENTS

| | | | | |
|---|---|---|---|---|
| JP | 02197677 | A | * | 8/1990 |
| JP | 04308604 | A | * | 10/1992 |

* cited by examiner

MECHANICAL LIFT, FULLY NESTING, TELESCOPING MAST

Priority to U.S. Provisional Patent Application Ser. No. 60/583,197, filed Jun. 25, 2004, is claimed, and which is herein incorporated by reference.

BACKGROUND OF THE INVENTION

1. Field of the Invention

The present invention relates generally to a telescoping mast that can be used for various applications.

2. Related Art

It is often necessary to raise or elevate objects, such as cameras or antennas. In addition, it is often necessary to temporarily raise such objects, such as at construction sites, events, etc. For example, elevated lights can be useful at construction sites. As another example, elevated cameras can be useful at sporting or recreational events.

Telescoping columns or towers have been proposed. Many, however, utilize a single continuous cable or line that requires a motor or crank to wind a large length of the cable or line. In addition, many use a single cable or line that subjects the column or tower to catastrophic failure if the cable or line is severed. In addition, many have configurations that are not fully nesting, and thus do not utilize space efficiently. In addition, many have configurations in which pulleys or column designs do not utilize space efficiently. Furthermore, many have configurations in which the cable or line is disposed outside, or is substantially exposed to the elements.

SUMMARY OF THE INVENTION

It has been recognized that it would be advantageous to develop a telescoping mast for various applications. In addition, it has been recognized that it would be advantageous to develop a telescoping mast which reduces the amount of line to be wound or pulled, with redundant lines or improved safety, which is capable of fully nesting and that has improved space efficiency, and that is capable of protecting the lines.

The invention provides a telescoping mast apparatus with a plurality of telescoping cylinders extendable upward from a base, and including at least an outer most cylinder, a first intermediate cylinder nested within the outermost cylinder, and a second cylinder nested within the first intermediate cylinder. A first strap extends around at least one lower roller near a bottom of the outermost cylinder, around an upper roller near a top of the outermost cylinder, and attached near a bottom of the first intermediate cylinder. An intermediate strap is discrete from the first strap and attached near a bottom of the outermost cylinder and extending around a lower roller near a bottom of the first intermediate cylinder, around an upper roller near a top the first intermediate cylinder, and attached near a bottom of the second intermediate cylinder.

In addition, the invention provides a telescoping mast apparatus with a plurality of telescoping cylinders and a plurality of straps. Each strap extends from near a bottom of an outer cylinder, around an upper roller near a top of the outer cylinder, and is attached near a bottom of an inner cylinder. The plurality of straps and the plurality of telescoping cylinders are intercoupled in series with alternating strap and cylinder.

In addition, the invention provides a telescoping mast apparatus with a plurality of telescoping cylinders and a pair of straps intercoupled in parallel between an outer cylinder and an inner cylinder. A plurality of laterally off-set rollers receives the straps around the rollers, displacing the strap laterally.

In addition, the invention provides a telescoping mast apparatus with a plurality of telescoping cylinders and at least one strap coupled between a take-up reel and the cylinders. A pair of rollers is disposed at a top of at least one of the cylinders, and the strap extends around an uppermost roller and past a lowermost roller.

In addition, the invention provides a telescoping mast apparatus with a plurality of telescoping cylinders and at least one strap intercoupled between a take-up reel and an inner cylinder. At least one roller is disposed at a top of an outer cylinder. The roller has a channel with a smaller diameter to receive the strap, and a flange with a larger diameter to bear against an adjacent cylinder.

In addition, the invention provides a telescoping mast apparatus with a plurality of telescoping cylinders and at least one strap coupled between a take-up reel and an inner cylinder with the strap extending inside the inner cylinder.

The invention provides a telescoping mast with a plurality of concentric, telescoping cylinders. The configuration of the mast allows the telescoping cylinders to be fully nesting. The telescoping mast includes a "pulley"-like system with straps for lifting the various sections. Multiple straps are used so that as a motor pulls one strap, all of the sections are raised. Rollers are disposed at the tops of the sections to receive the straps. The straps can be doubled-up, or each section can include two straps for redundancy. A series of re-alignment rollers shifts the second or double strap horizontally so that both straps can be coupled to a single take-up reel coupled to a motor.

Additional features and advantages of the invention will be apparent from the detailed description which follows, taken in conjunction with the accompanying drawings, which together illustrate, by way of example, features of the invention.

DETAILED DESCRIPTION

Figure 1:
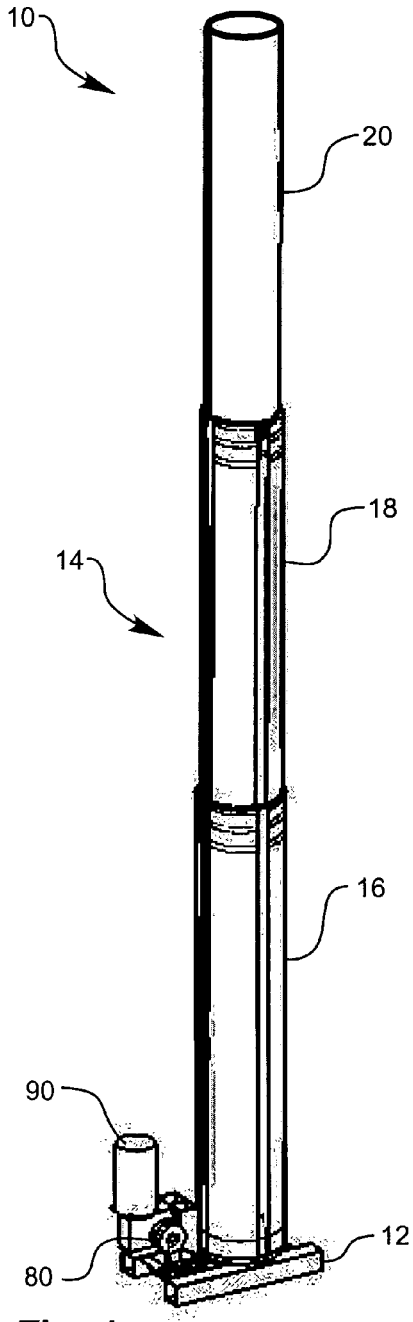
FIG. 1 is a perspective view of a telescoping mast in accordance with an embodiment of the present invention, shown in an extended configuration.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 1-6, a telescoping mast 10 in accordance with the present invention is shown that can be used for various applications. For example, the mast can be used to elevate various devices, such as cameras, antennas, satellite dishes, lights, etc., for use in fields such as surveillance, communications, construction, etc. The configuration of the mast allows the telescoping sections to be fully nesting. Thus, the mast can have an efficient and compact size when stowed to facilitate transportation, concealment, etc. The telescoping mast includes a "pulley"-like system with straps for lifting the various sections. Multiple straps are used so that as a motor pulls one strap, all of the sections are raised. Rollers are disposed at the tops of the sections to receive the straps. The straps can be doubled-up, or each section can include two straps for redundancy. A series of re-alignment rollers shifts the second or double strap horizontally so that both straps can be coupled to a single take-up roller coupled to a motor.

Figure 2:
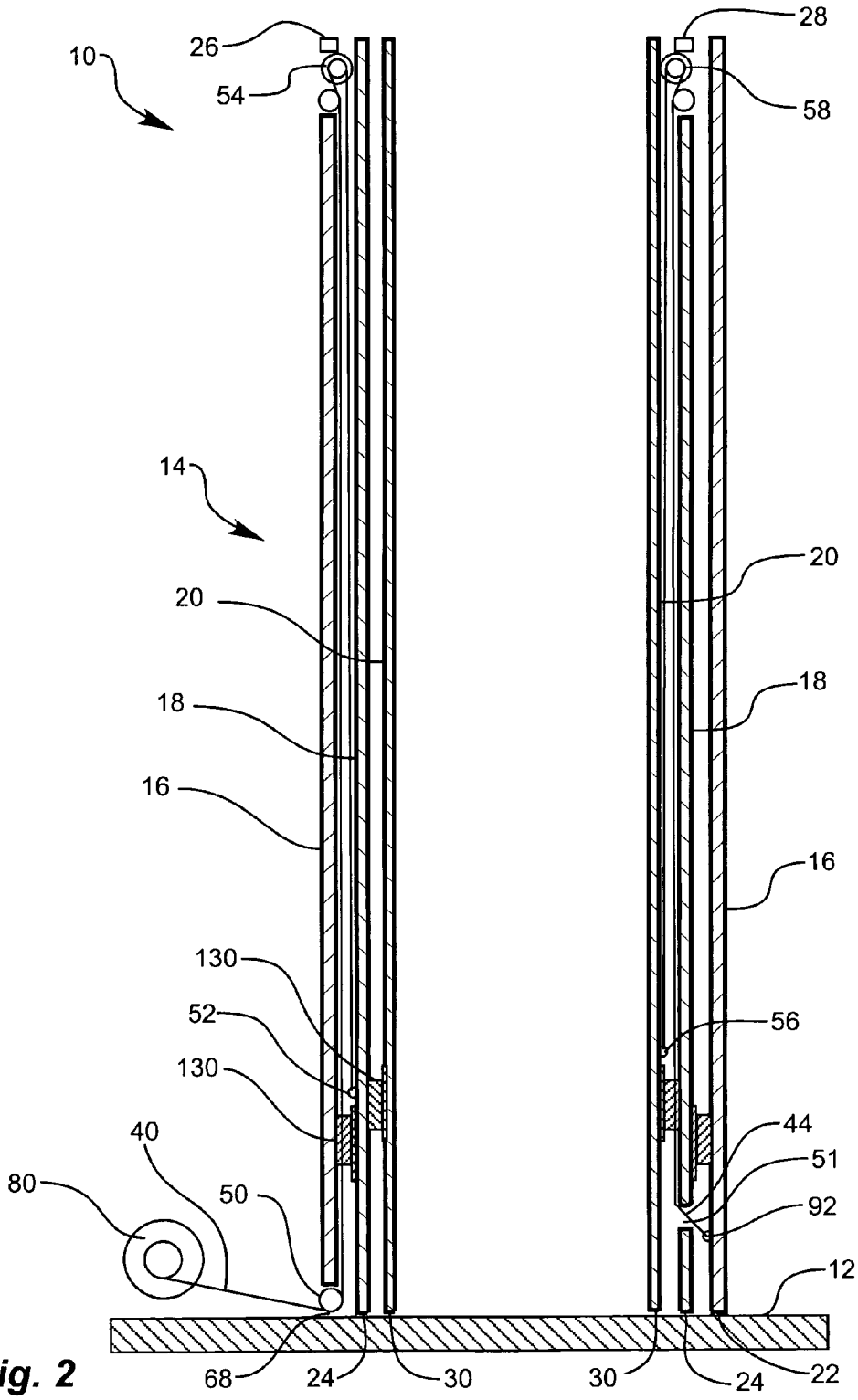
FIG. 2 is a cross-sectional side schematic view of the telescoping mast of FIG. 1, shown in a retracted configuration and illustrating a configuration of a plurality of cylinders and a plurality of straps of the mast.

Referring to FIGS. 1-2, the telescoping mast 10 is shown in accordance with an embodiment of the present invention. The telescoping mast 10 can include a base 12, a plurality of telescoping cylinders 14, a first strap 40 (FIG. 2), and an intermediate strap 44 (FIG. 2). The first strap 40 can be attached to a take up reel 80 that can be rotated by a motor 90. Thus, the mast can include at least two discrete or separate straps, including the first strap and the intermediate strap. The straps 40 and 44 can be flat, or have a rectangular cross-sectional shape with one dimension substantially larger than an orthogonal dimension. Thus, the flat straps can allow the straps to be stronger, or have a greater cross-sectional area, and can allow the telescoping cylinders 14 to be spaced closer together to efficiently utilize space. The straps can be formed of woven polyester.

The plurality of telescoping cylinders 14 can include an outermost cylinder 16, a first intermediate cylinder 18 nested within the outermost cylinder, and a second intermediate or inner cylinder 20 nested within the first intermediate cylinder. Thus, the mast or telescoping cylinders can include at least three cylinders, including the outermost cylinder, at least one intermediate cylinder, and an innermost cylinder. The cylinders can be concentric and can extend upward from the base. The outermost cylinder 16 can be fixed with respect to the base 12, while the remaining cylinders can extend and retract along a longitudinal axis of the cylinders. The cylinders can have a tubular configuration and can have a circular or annular cross-sectional shape, as shown. Alternatively, the cylinders can have any desired cross-sectional shape, including for example, square, rectangular, triangular, etc.

Although the three cylinders 16, 18 and 20 will be described herein, it is understood that any number of cylinders, or a plurality of intermediate cylinders, can be provided. Similarly, although two straps 40 and 44 will be described herein, it is understood that a plurality of straps, or a plurality of intermediate straps, can be provided depending on the number of cylinders. As stated above, the mast can include at least three cylinders and at least two straps. The cylinders and the straps can be connected in alternating series. Thus, the plurality of intermediate cylinders and the plurality of intermediate cylinders can be coupled in series with alternating cylinders and straps, as described in greater detail below.

Referring to FIG. 2, a plurality of rollers can be provided on the cylinders 14 to guide the straps. Each strap can extend from a bottom of an outer cylinder, to the top of the outer cylinder, and to the bottom of an inner cylinder to raise the inner cylinder. The motor 90 and take up reel 80 can pull the first strap 40 to raise the first intermediate cylinder 18. The first strap 40 can extend around at least one lower roller 50 near a bottom 22 of the outermost cylinder 16 and into the inside of the outermost cylinder. Thus, the first strap 40 can extend from the motor 90 and take up reel 80 outside the outermost cylinder, through an aperture in the outermost cylinder, and into the interior of the outermost cylinder. The first strap 40 can then extend around an upper roller 54 near a top 26 of the outermost cylinder. The first strap 40 can then be attached to an attachment point 52 near a bottom 24 of the first intermediate cylinder 18. It will be appreciated that when the motor 90 and take up reel 80 exert a force on the first strap 40, or pull the first strap 40, the first intermediate cylinder 18 will rise from the outermost cylinder 16. Disposing the strap 40 on the inside of the cylinder 16 can protect the strap from environmental conditions.

The intermediate strap 44 can be discrete and separate from the first strap 30. The intermediate strap 44 can be attached to an attachment point 92 on the inside and near the bottom 22 of the outermost cylinder 16. The intermediate strap can extend through an aperture 51 near the bottom 24 of the first intermediate cylinder 18, around an upper roller 58 near a top 28 the first intermediate cylinder 18, and can then be attached to an attachment point 56 near a bottom 30 of the second intermediate cylinder 20. Thus, as the first intermediate cylinder 18 extends from the outermost cylinder 16, it lifts the intermediate strap 44 which is attached to the outermost cylinder at the attachment point 92, causing the intermediate strap 44 to lift the second cylinder 20 from the first intermediate cylinder 18.

Figure 3:
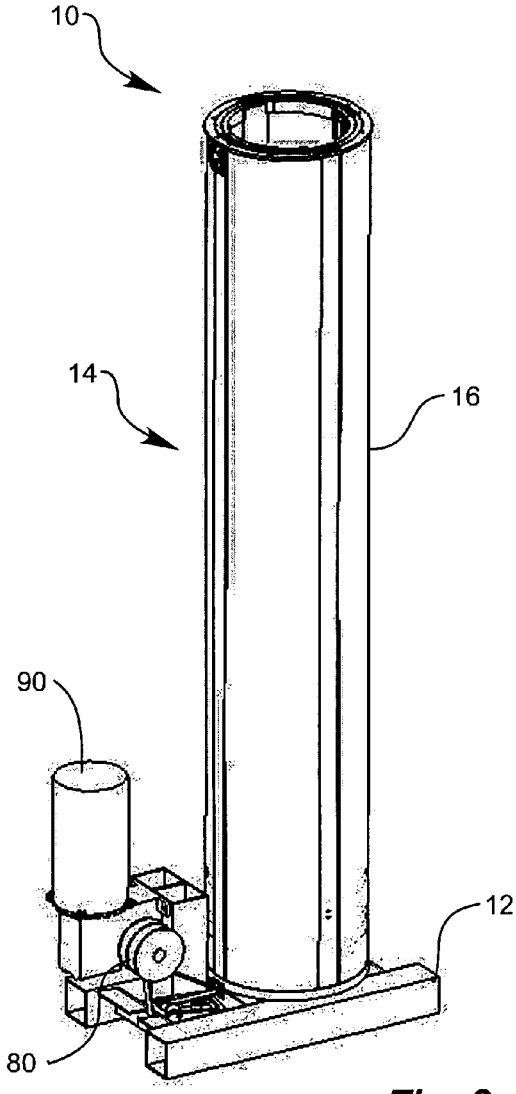
FIG. 3 is a perspective view of the telescoping mast of FIG. 1, shown in a stowed configuration.

The plurality of telescoping cylinders 14 can be extended between a nested position, as shown in FIG. 3, in which all of the cylinders are fully nested within the outermost cylinder, and an extended position, as shown in FIG. 1, in which each cylinder is raised substantially out of the outermost cylinder 16. The plurality of telescoping cylinders 14 can be raised to the extended position by retracting the first strap 40 from the outermost cylinder 16. As the first strap 40 is retracted from the outermost cylinder 16, the first strap tensions around the upper roller 54, which acts like a pulley, drawing the bottom 24 of the first intermediate cylinder 18 toward the upper roller 54, thereby raising the first intermediate cylinder. As the first intermediate cylinder 18 is raised, the intermediate strap 44 is retracted from the first intermediate cylinder. As the intermediate strap 44 is retracted from the intermediate cylinder 18, the intermediate strap tensions around the upper roller 58, which acts like a pulley, drawing the bottom of the second intermediate cylinder 20 toward the upper roller, thereby raising the second intermediate cylinder. Thus, the telescoping mast 10 can raise the series of nested, concentric cylinders 14.

The configuration of the straps and cylinders described above disposed substantially all of the straps inside the cylinders to protect the straps from the elements. Protective covers (removed from the figures for illustration purposed) can be disposed over the upper rollers to protect the straps as they extend around the rollers.

Figure 7:
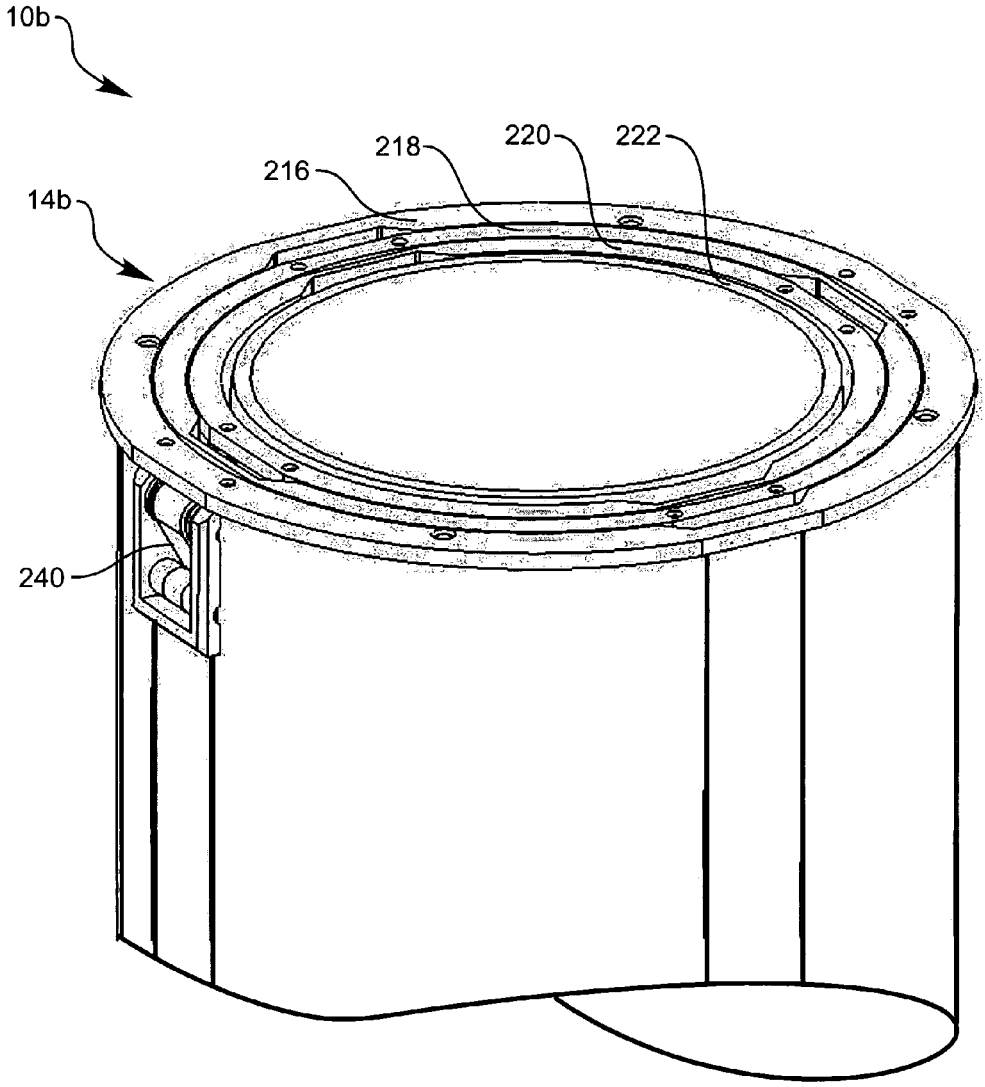
FIG. 7 is a partial perspective view of a telescoping mast in accordance with another embodiment of the present invention, shown in a fully stowed configuration.
Figure 8:
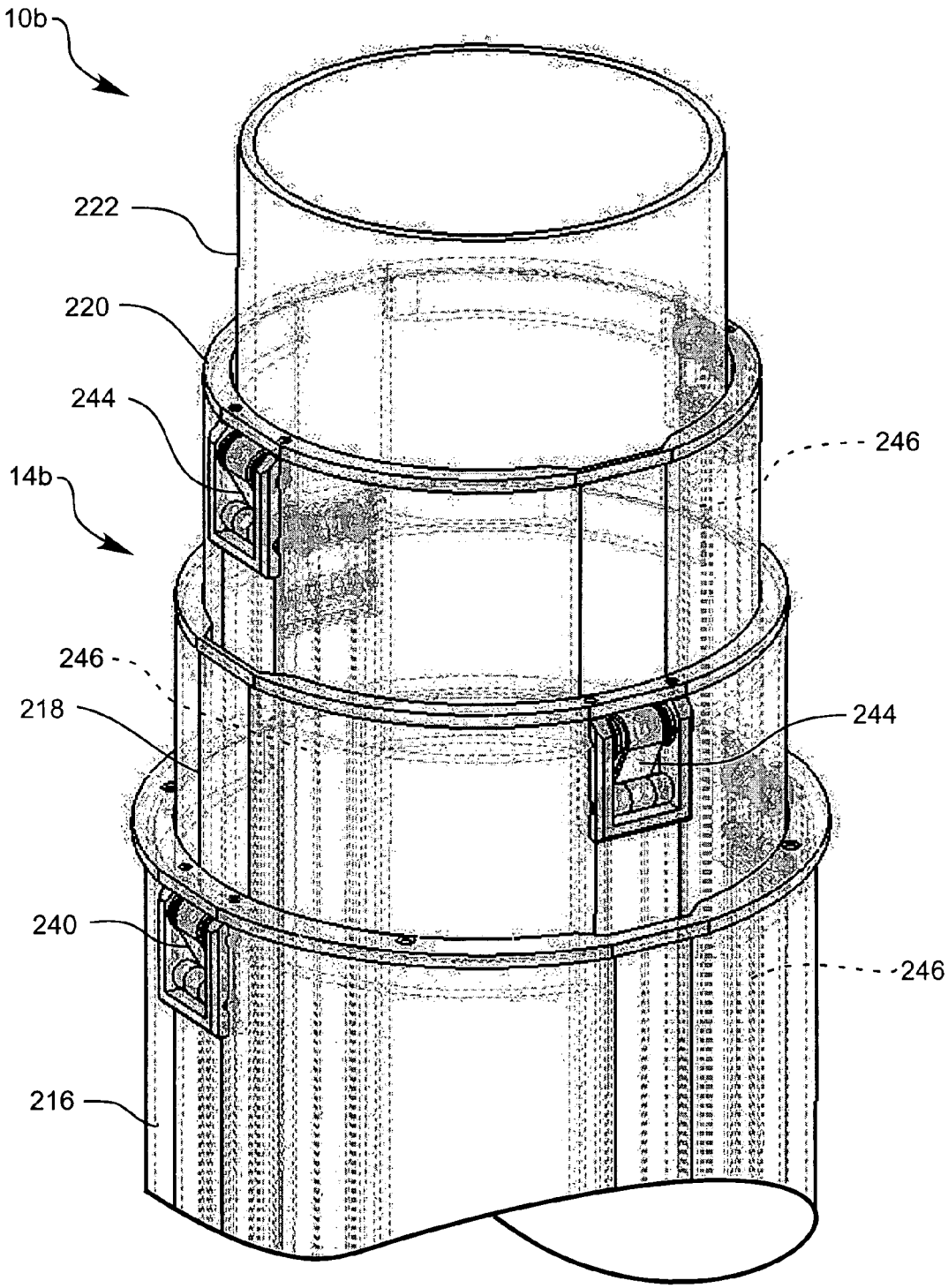
FIG. 8 is a partial perspective view of the telescoping mast of FIG. 7, shown in a partially extended configuration.
Figure 13:
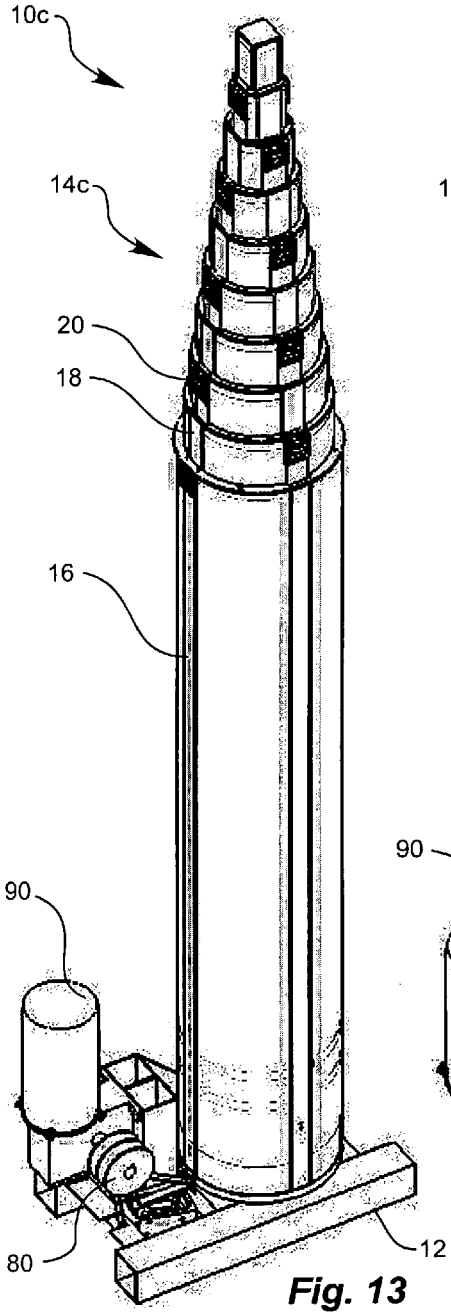
FIG. 13 is a perspective view of a telescoping mast in accordance with another embodiment of the present invention, shown in a partially extended configuration.
Figure 14:
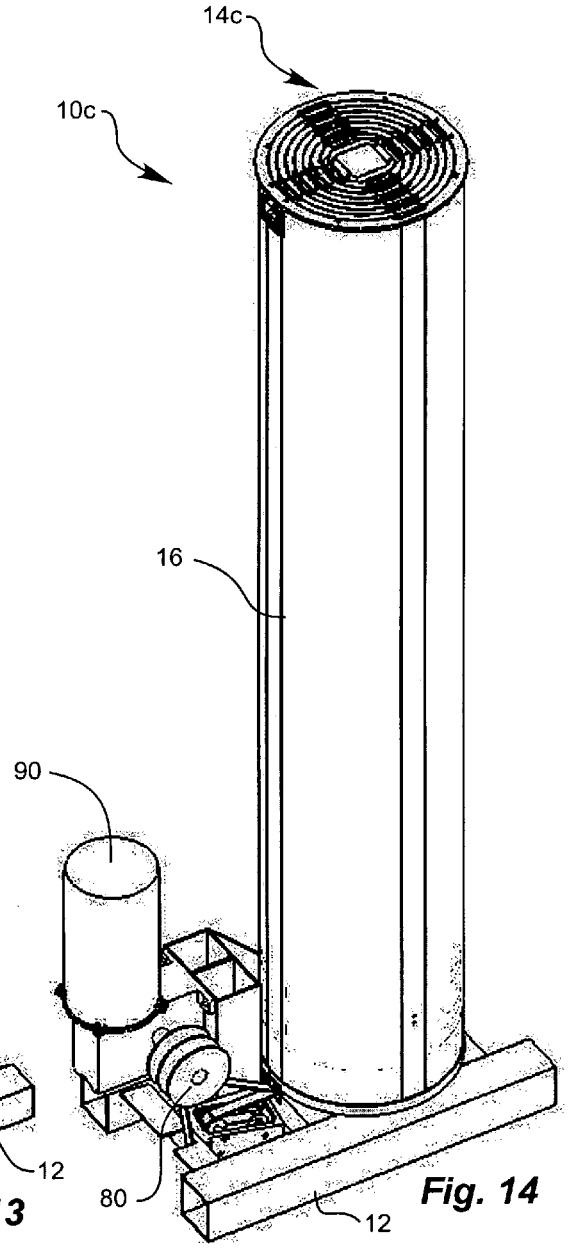
FIG. 14 is a perspective view of the telescoping mast of FIG. 13, shown in a fully stowed configuration.
Figure 15:
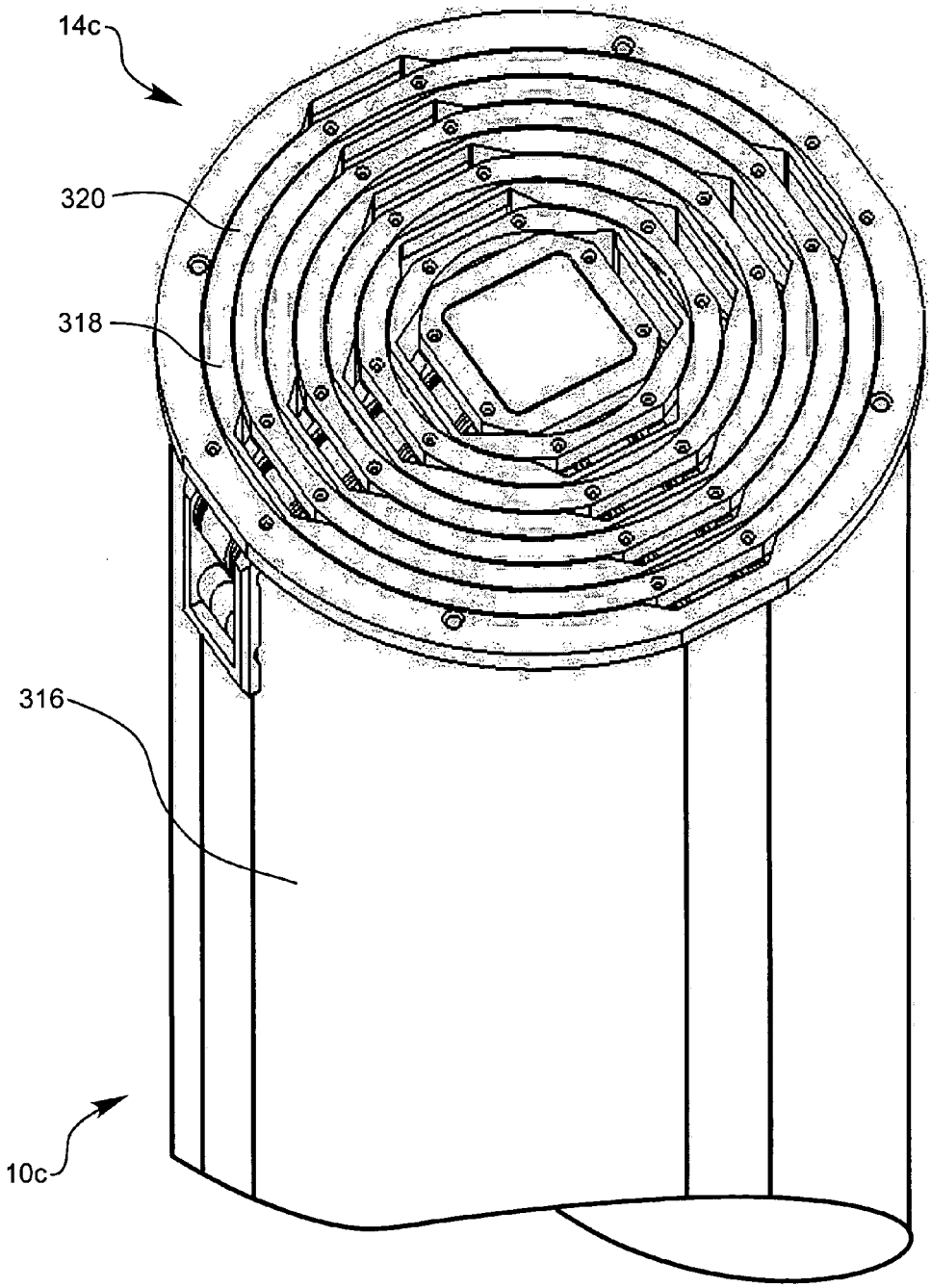
FIG. 15 is a partial perspective view of the telescoping mast of FIG. 13 shown in a fully stowed configuration.

As illustrated in FIGS. 7 and 8, another telescoping mast 10*b* can have a plurality of intermediate cylinders 14*b* nested inside the first intermediate cylinder 218. As illustrated in FIGS. 13-15, another telescoping mast 10*c* can have an outermost cylinder 316, a first intermediate cylinder 318, a second intermediate cylinder 320, and a plurality of intermediate cylinders 14*c* nested inside the second intermediate cylinder 320. Additionally, the mast can utilize any number of cylinders, including for example three cylinders 14, as shown in FIGS. 1-3, four cylinders 14*b*, as shown in FIGS. 7 and 8, and ten cylinders 14*c*, as shown in FIGS. 13-15. The cylinders can be configured to be fully nesting, such that all intermediate cylinders are contained within the outermost cylinder 16 in the retracted position. Thus, the mast efficiently conserves space, and can facilitate transportation, concealment, etc. The mast height can be dependant on the height and number of individual cylinders in the plurality of telescoping cylinders, including for example a height of approximately 6 feet when stowed, and a height of approximately 60 feet when extended. It is of course understood that the cylinders can have different lengths, and the mast can have different numbers of cylinders, that will determine the stowed and extended lengths of the mast. The masts can be formed of a composite material. Thus, the mast can have high strength and relatively light weight.

A plurality of intermediate straps can be intercoupled in series with alternating cylinders and straps. Specifically, each intermediate strap can be attached to a first relatively larger intermediate cylinder. The intermediate strap can extend around an upper roller on a second relatively smaller intermediate cylinder, and can be attached to a third relatively smaller intermediate cylinder nested inside the second intermediate cylinder. Thus, each intermediate strap can be attached similar to the arrangement described above for the outermost, first and second intermediate cylinders shown in FIGS. 1-3.

All of the straps, including the first strap 40 and each intermediate strap 44, can be relatively thin and flat, and allow the nesting cylinders to efficiently utilize space within the outermost cylinder. Because of the thin, flat strap configuration and roller design, the cylinders can fully nest within each other so the stowed mast results in a horizontal surface with no protruding cylinders. The strength of the each strap can be designed such that the entire mast assembly can be raised by just one strap.

Figure 4:
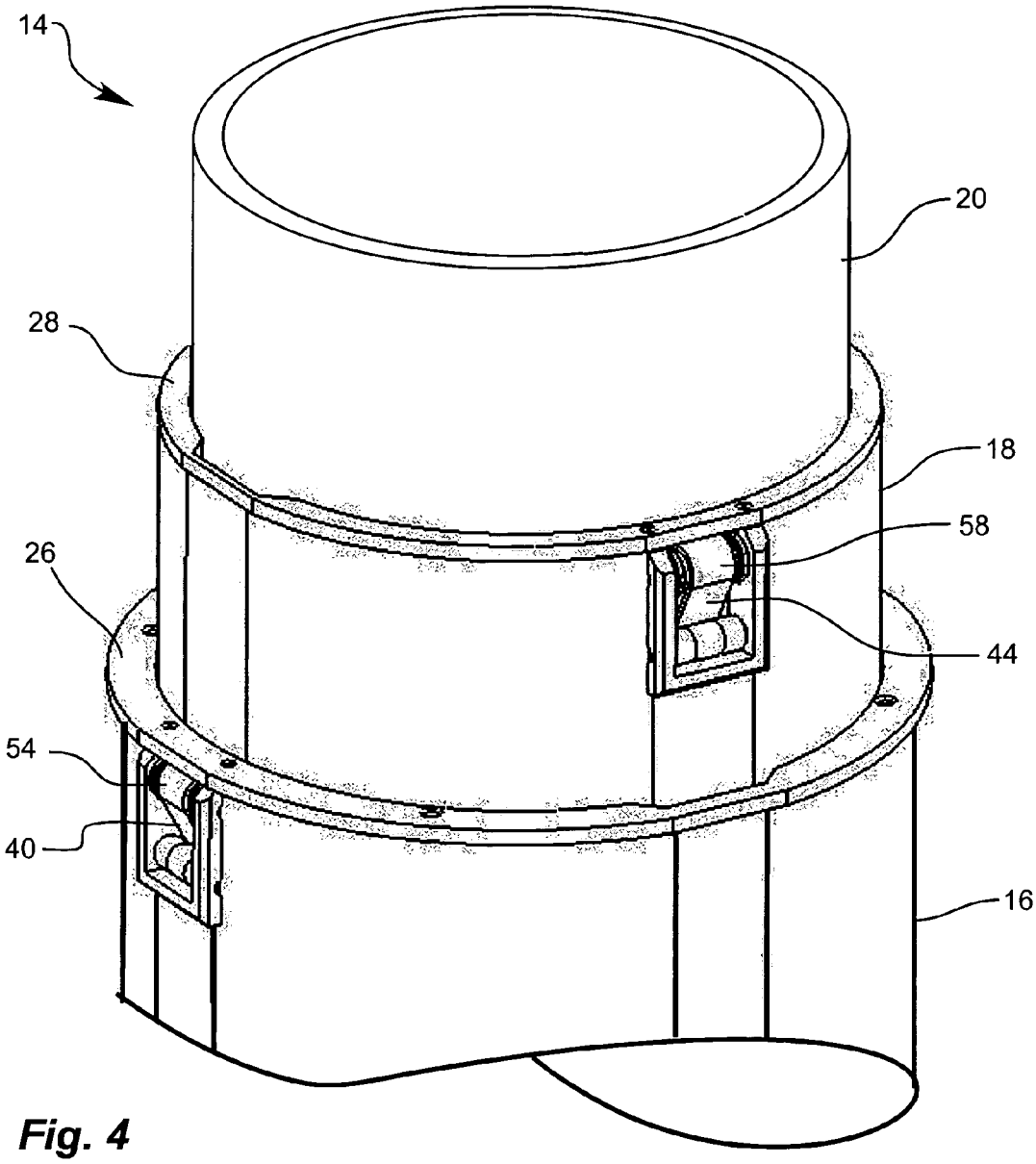
FIG. 4 is a partial perspective view of the telescoping mast of FIG. 1, shown in a partially extended configuration.
Figure 5:
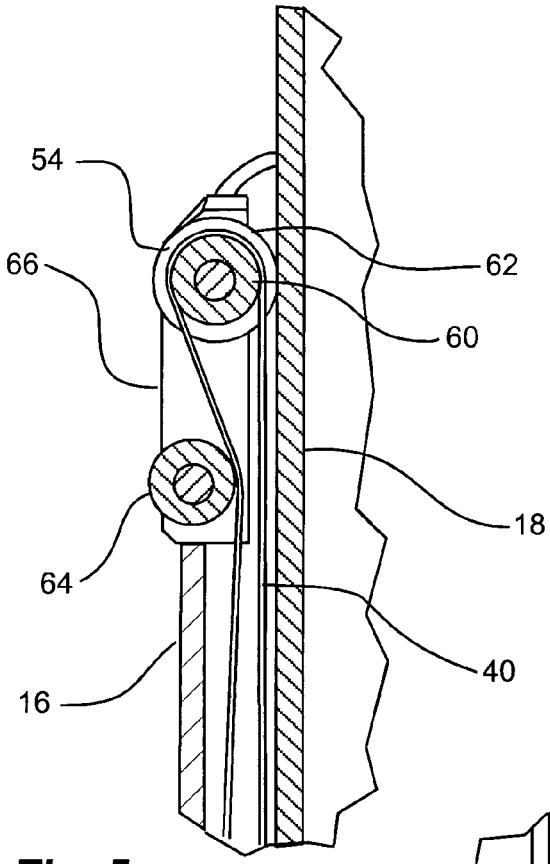
FIG. 5 is a partial cross-sectional side view of the telescoping mast of FIG. 1 showing a strap and an upper roller assembly on an outermost cylinder of the telescoping mast.
Figure 6:
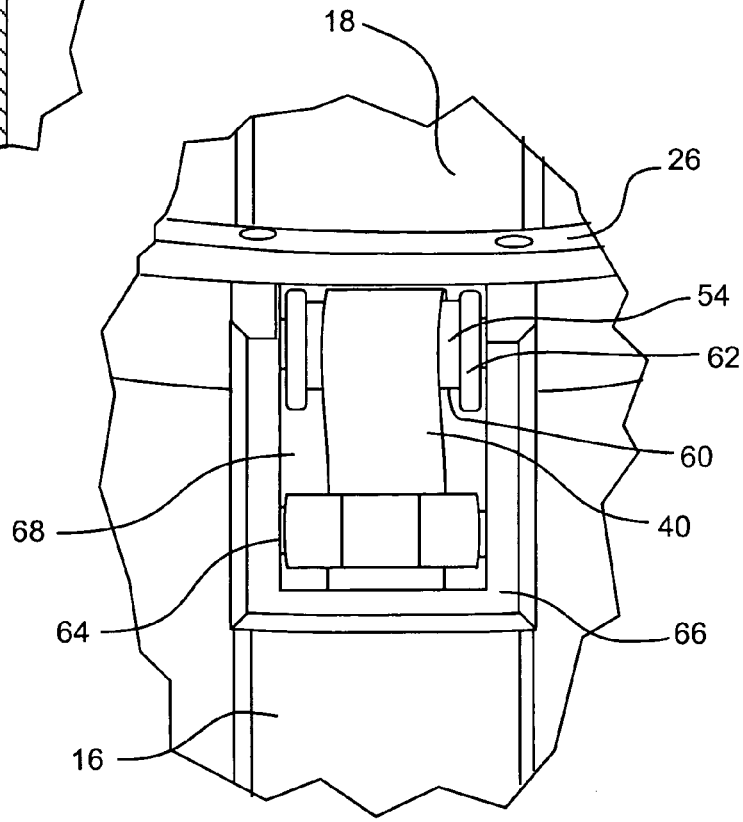
FIG. 6 is a partial perspective view of the telescoping mast of FIG. 1 showing the strap and upper roller assembly.

Referring to FIGS. 4-6, the upper roller 54 is shown in greater detail. Specifically, FIG. 4 illustrates the top portions of the plurality of telescoping cylinders 14 in a partially extended configuration exposing upper rollers 54 and 58. FIG. 5 illustrates a cross section view of an upper roller 54. FIG. 6 illustrates a cut away view of an upper roller 54. A protective cover over the roller 54 has been removed in FIGS. 4-6 to illustrate the operation of the straps and the rollers.

The upper roller 54 can be located near the top 26 of the outermost cylinder 16. Similarly, the upper roller 58 can be located near the top 28 of the first intermediate cylinder 18. Referring to FIGS. 5 and 6, the upper rollers, illustrated by the upper roller 54, can have a channel 60 with a smaller diameter to receive the strap 40, and flanges 62 with a larger diameter that can bear against an adjacent cylinder 18, and can maintain the position of the strap. A second roller 64 can be paired with the upper roller 54 to direct the strap from the inside of the outermost cylinder to the upper roller. The rollers can redirect the straps so they are fully enclosed within the telescoping cylinders, resulting in no exposed components as the cylinders are raised. An upper aperture 68 can be formed in the top 26 of the cylinder, and the upper roller 54 and lower roller 64 can be disposed in the aperture. Thus, the rollers are disposed at least partially within a thickness of the cylinder, conserving space and reducing gaps between adjacent cylinders. The size and position of the rollers 54 and 64 can be configured to position the strap 40 adjacent an interior of the outermost cylinder as it extends to the upper roller, and adjacent an exterior of the first interior cylinder 18 as it extends from the upper roller, as best shown in FIG. 5.

Figure 9:
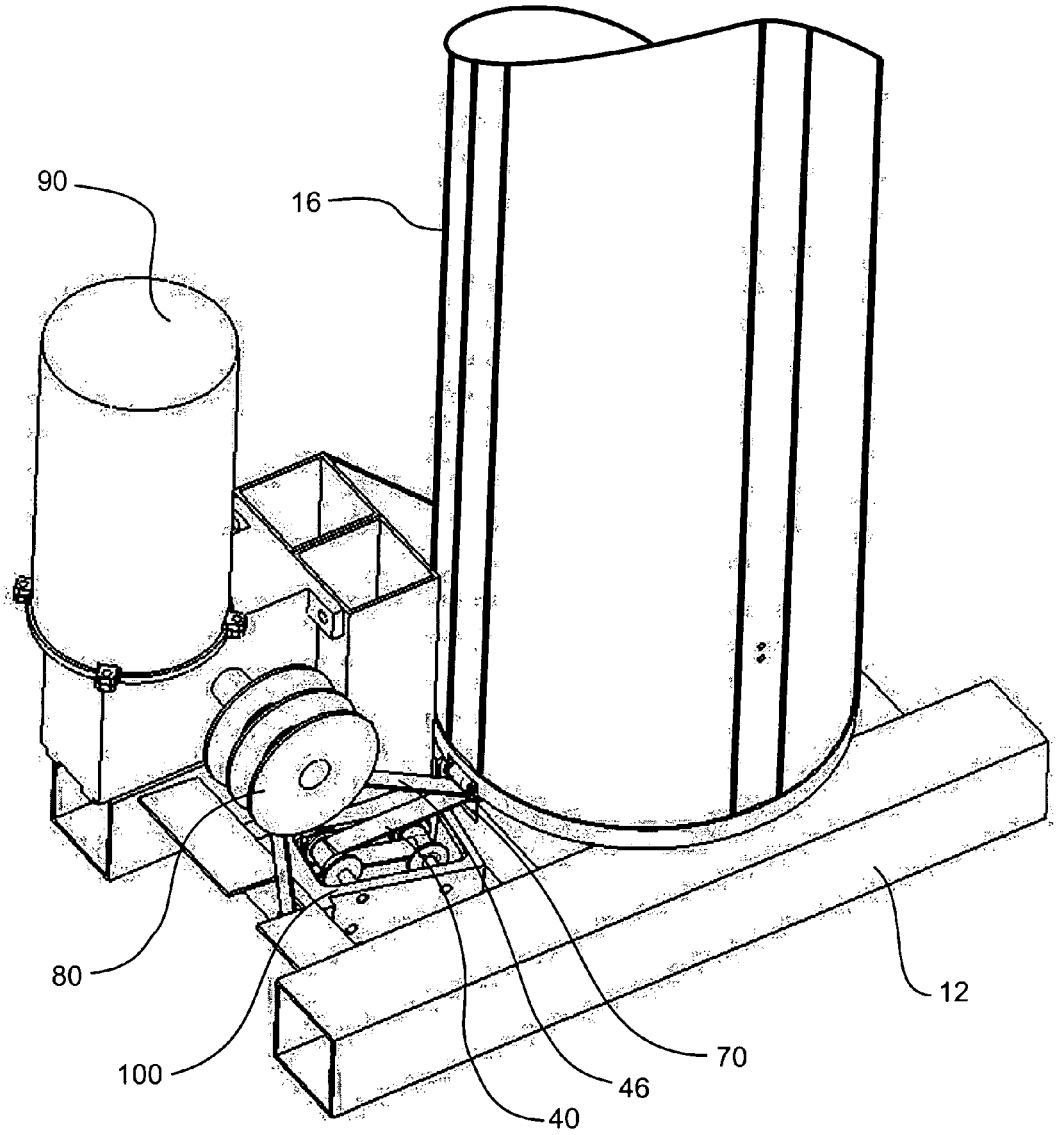
FIG. 9 is a partial perspective view of the telescoping mast base of FIG. 1.

In the two-roller configuration, shown in FIGS. 5 and 6, the strap 40 rolls over the upper roller 54 which creates a lifting force as the mast is raised. The lower roller 64 directs the strap inside the cylinder as the strap travels down to the bottom of the cylinder 16. An illustration of how the strap passes through the cylinder at the bottom of each concentric cylinder is shown in FIGS. 2 and 9. Once the strap reaches the bottom of the cylinder 16, the strap 40 is then redirected back outside the cylinder. A lower aperture 70 can be formed in the cylinder 16 so that the strap can pass through the cylinder. Once outside the cylinder, the strap can then be attached to either the inside bottom of the next concentric cylinder if the strap is an intermediate strap, or to a take up reel 70 if the strap is the first strap.

Since the straps and rollers are designed to fit between the concentric cylinder walls, the cylinders are allowed to stow completely inside each other. Referring to FIGS. 7 and 8, a four cylinder mast 10*b* is shown stowed and partially extended, respectively, with a partially extended internal view shown in dashed lines. The first strap 240 and intermediate straps 244 are internal to each concentric telescoping cylinder 216, 218, 220, and 222, so the straps are protected from the outside environment of the telescoping mast. The clocking of the strap location alternates between 0°/180° and 90°/270° as the cylinders nest inside each other. There are also redundant straps 246 attached to each cylinder, that extend in parallel with the other straps, so the mast will stay erect even with the failure of one strap per cylinder. This method of redirecting the straps as they move in and out of the cylinders is repeated for each concentric cylinder.

As noted previously, the manner in which the straps are attached to the concentric cylinders results in the lifting of the mast. Referring again to FIGS. 1-4, as the straps alternate between the 0°/180° and 90°/270° location, they also alternate attachment between the successive concentric telescoping cylinders. For example, the first strap 40 attached to the take-up reel 80 travels under the outermost cylinder 16 at 0°, rolls over the top roller 54 on the outermost cylinder, and then is attached to the outside bottom 24 of the first intermediate cylinder 18. The next strap 44 is attached to the inside bottom 22 of the outermost cylinder at 90°, travels through the first intermediate cylinder 18 at the bottom 24 and continues over the top roller 58 of the first intermediate cylinder, and then is attached to the outside bottom 30 of the second intermediate cylinder 20.

This alternating strap attachment on the inside of one cylinder; over the next concentric cylinder; and attachment to the outside of the next successive concentric cylinder, sets up the mechanism to lift the entire telescoping mast. As the outermost strap 40 is wound onto the take-up reel 80, it raises the first intermediate cylinder 18. The elevation of the first intermediate cylinder in turn raises the second intermediate cylinder 20, since there is a strap 40 attached to the stationary outermost cylinder 16, over the first intermediate cylinder 18, and attached to the second intermediate cylinder 20. As the first intermediate cylinder moves up the next strap 44 is pulled up raising the second intermediate cylinder 20. This method of alternating straps between the concentric cylinders lifts the entire mast.

An interesting result of this method is a mechanical advantage gained as each cylinder is lifted. For every three concentric cylinders, the elevation speed is doubled. In other words, a third intermediate cylinder's speed up is twice the speed of the first intermediate cylinder. As a result of this mechanical advantage the strap tension is significantly greater for the lower cylinder straps. However, the mechanical advantage means that the first strap only has to travel a short distance to raise the entire mast. For a ten cylinder telescoping mast design, the take-up reel 80 can gather in approximately 60 inches of strap to raise the mast more than 600 inches high. This is a significant design change from similar telescoping mast with continuous lifting cables that weave through the entire mast requiring a large length of cable to be spooled on the take-up reel.

Referring back to FIGS. 2 and 9, the outermost cylinder 16 can have the strap 40 pass from inside to outside near the bottom 22 of the cylinder as it continues to the take-up reel 80. The take up reel 80 can be attached to a motor 90, such as a DC or an AC/DC motor. The first strap 40 and first redundant strap 46 can both pass through the lower aperture 70. The first strap 40 is simply rolled directly onto the take-up reel 80, while the first redundant strap 46 is directed through an alignment frame 100 (FIG. 9) attached to the base 12. The alignment frame 100 shifts the first redundant strap 46 laterally, and aligns it with the take up reel 80. The re-alignment of the first redundant strap 46 allows a single take-up reel 80 to be used, while maintaining identical strap take-up speeds for both straps 40 and 46.

The alignment frame 100 is another unique feature of the telescoping mast. The alignment frame 100 laterally re-aligns the straps 40 and 46 so there they can be rolled onto a single take-up reel 80 while maintaining equal speed of each strap. If one strap moves faster than the other, the tension in the slower strap will decrease. A loss of tension means that the entire load is being carried by one strap. To laterally move the strap a series of re-alignment rollers are held in an alignment frame 100.

Figure 10:
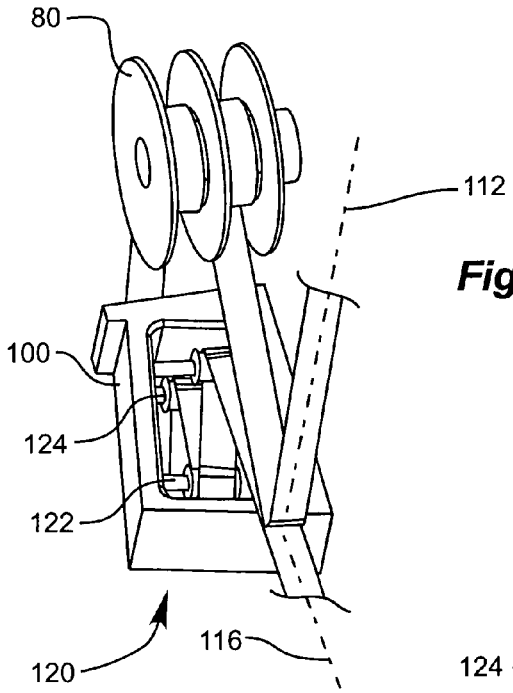
FIG. 10 is a partial perspective view of an alignment frame including a plurality of off-set rollers of the telescoping mast of FIG. 1.
Figure 11:
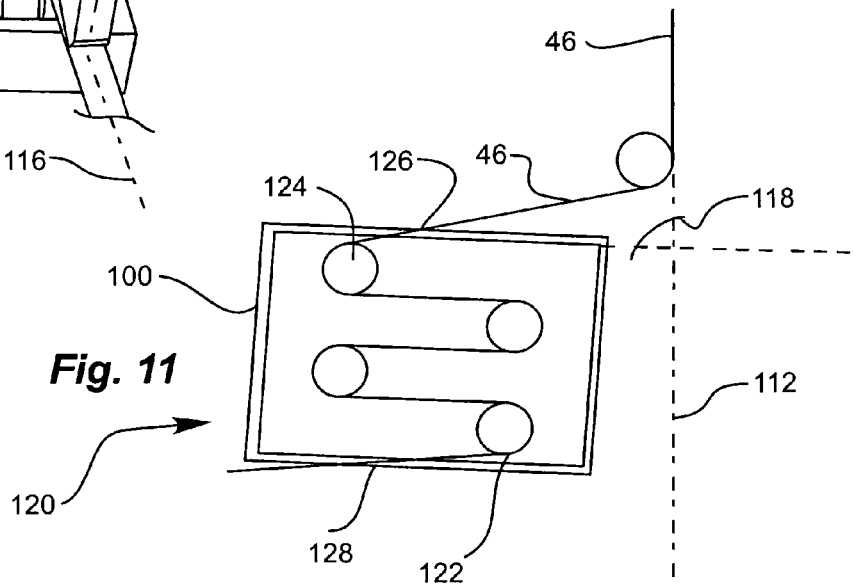
FIG. 11 is a side view of the alignment frame and plurality of rollers of FIG. 10.
Figure 12:
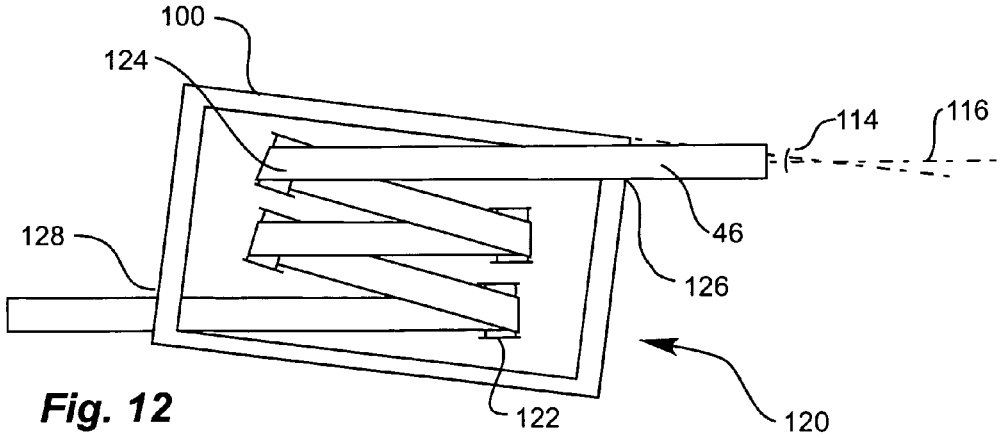
FIG. 12 is a top view of the alignment frame and plurality of rollers of FIG. 10.

The alignment frame 100 is illustrated in FIGS. 9-12. Specifically, FIG. 9 shows a cut away perspective view of the bottom portion of the telescoping mast 10. FIG. 10 illustrates a cut away perspective view of the take up reel 80 and alignment frame 100 including the first strap 40 and first redundant strap 46. FIG. 11 is a side view of the alignment frame including the first redundant strap. FIG. 12 is a top view of the alignment frame including the first redundant strap.

The alignment frame 100 can be mounted to the base 12 at an angle 114 to the lateral axis 116 of the strap and at an angle 118 to the upward axis 112 of the strap. For example, the alignment frame can be mounted on the base at an angle of 10° with respect to the lateral axis of the strap and an angle of 85° with respect to the upward axis of the strap.

The alignment frame 100 can have a plurality of laterally off-set rollers 120. For example, the alignment frame can have two forward rollers 122 located near the strap entrance 126 to the frame, and two rear rollers 124 located near the strap exit 128 from the frame. The forward rollers can be at a relatively smaller angle, such as an angle of 5°, with respect to the lateral axis 116 of the first redundant strap 46 and the rear rollers can be at a relatively larger angle, such as an angle of 10°, with respect to the lateral axis 116 of the first redundant strap. The first redundant strap 46 can travel through the plurality of off-set rollers 120 and can be laterally displaced by the rollers.

Thus, as the first redundant strap 46 moves through the plurality of off-set rollers 120, the strap is moved horizontally in 5° increments. This small angular increment insures that wear on the strap is reduced by reducing the distortion and twisting of the strap. As shown in FIG. 10, the first redundant strap can enter the alignment frame at the top and exit at the bottom having been translated laterally approximately 1.25 inches allowing the strap to be wound onto the take-up reel at the same speed as the other strap.

The alignment of the cylinders as the mast is raised can be maintained using a series of annular bearings 130 that can be attached to the outside of each nested cylinder near the bottom, as illustrated in FIG. 2. Each annular bearing can substantially circumscribe one of the plurality of telescopic cylinders, bearing against an adjacent cylinder, and aligning the plurality of telescoping cylinders. The annular bearings can be made of a low friction material such as nylon. The annular bearings can slide up and down on the inside surface of each cylinder as the mast is raised or lowered. In addition, as noted above, the upper rollers near the top of each cylinder will periodically roll against the outer surface of the concentric cylinder. This contact at the top of the cylinder provides an additional location to stabilize and align the cylinders as the cylinders move up and down.

The telescopic mast 10, or cylinders 14, can be formed of composite material (such as lightweight carbon fiber). The telescoping mast can have applications in Homeland Defense, Port and Stadium Security, Surveillance, Law Enforcement and broadcast news media. The mast can have up to 11, five-foot tall sections that will allow raising small cameras or other payloads up to about 50 feet in the air, quickly. The carbon fiber composite cylinders can be filament wound, cured and machined to final dimensions using conventional, commercially available materials and processes. The cylinders can be raised by actuating a low voltage bi-directional motor, gearing, and nylon straps that when pulled taut (by the motor) raise each section simultaneously. The mast can be guyed in four locations to assure stability during use and display. The mast can include a small video camera or other items mounted atop the mast. Alternatively, items can be disposed within the innermost cylinder, and protected within the mast when retracted. The mast can include a power supply (battery) and gear box, mounted in a lightweight aluminum box. The box can have wheels and drop-down, telescoping legs that will allow the box and telescoping mast to roll around on a hard, flat surface, or to rest on a slightly uneven surface and still erect vertically. The box can have a "receiver hitch" to be towed by a suitable vehicle.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed:

1. A telescoping mast apparatus, comprising:

a) a base;

b) a plurality of telescoping cylinders, extendable upward from the base, and including at least an outermost cylinder, an intermediate cylinder nested within the outermost cylinder, and an inner cylinder nested within the intermediate cylinder;

c) a first strap, extending around at least one lower roller near a bottom of the outermost cylinder, around an upper roller near a top of the outermost cylinder, and attached near a bottom of the intermediate cylinder; and d) an intermediate strap, discrete from the first strap, attached near a bottom of the outermost cylinder and extending through an aperture near a bottom of the intermediate cylinder, around an upper roller near a top the intermediate cylinder, and attached near a bottom of the inner cylinder.

2. A telescoping mast apparatus in accordance with claim 1, wherein the plurality of cylinders is extendable by retracting the first strap from the outermost cylinder which raises the intermediate cylinder which retracts the intermediate strap from the intermediate cylinder which raises the inner cylinder.

3. A telescoping mast apparatus in accordance with claim 1, wherein the plurality of telescoping cylinders, further comprises:

a plurality of intermediate cylinders, nested inside the outermost cylinder; and a plurality of intermediate straps, intercoupled in series with alternating cylinders in the plurality of intermediate cylinders.

4. A telescoping mast apparatus in accordance with claim 1, wherein the plurality of telescoping cylinders, further comprises:

a pair of rollers, disposed near a top of at least one of the cylinders, the strap extending around an upper roller and past a lower roller.

5. A telescoping mast apparatus in accordance with claim 1, wherein the plurality of telescoping cylinders, further comprises:

at least one roller, disposed near a top of a cylinder, the roller having a channel with a smaller diameter to receive the strap, and a flange with a larger diameter to bear against an adjacent cylinder.

6. A telescoping mast apparatus in accordance with claim 1, further comprising:

a plurality of annular bearings, each annular bearing substantially circumscribing one of the plurality of telescopic cylinders, bearing against an adjacent cylinder, and aligning the plurality of telescoping cylinders.

7. A telescoping mast apparatus in accordance with claim 1, wherein the plurality of telescoping cylinders are formed of a composite material.

8. A telescoping mast apparatus in accordance with claim 1, further comprising:

a motor, disposed adjacent the plurality of telescoping cylinders, and having a take up reel for at least one of the straps.

9. A telescoping mast apparatus in accordance with claim 1, wherein the first strap includes a pair of first straps coupled in parallel but at different locations, and further comprising:

a plurality of laterally off-set rollers, receiving one of the pair of first straps around the rollers, displacing the strap laterally with respect to another of the pair of first straps.

10. A telescoping mast apparatus in accordance with claim 9, wherein the plurality of laterally off-set rollers further comprises:

an alignment frame mounted on the base at an angle to the lateral axis of the strap and at an angle to the upward axis of the strap;

a first plurality of rollers disposed in the alignment frame and offset at a relatively smaller angle with respect to the lateral axis of the strap; and a second plurality of rollers disposed in the alignment frame and offset at a relatively larger angle with respect to the lateral axis of the strap.

11. A telescoping mast apparatus in accordance with claim 1, wherein the first strap includes a pair of redundant straps, each redundant strap intercoupled in parallel with respect to one another between a take-up reel and the intermediate cylinder, and offset from one another at the take-up reel.

12. A telescoping mast apparatus in accordance with claim 1, wherein the first strap includes at least two straps attached in parallel between a take-up reel and the intermediate cylinder.

13. A telescoping mast apparatus in accordance with claim 1, further comprising:

a square tube coupled to the base and configured to be received in a receiver hitch of a vehicle.

14. A telescoping mast apparatus in accordance with claim 13, further comprising:

a plurality of drop-down, telescoping legs coupled to the base.

15. A telescoping mast apparatus, comprising:

a) a plurality of telescoping cylinders;

b) a plurality of straps, each strap extending from near a bottom of an outer cylinder, around an upper roller near a top of the outer cylinder, and attached near a bottom of an inner cylinder, including:

i) a first strap, extending around at least one lower roller near a bottom of an outermost cylinder, around an upper roller near a top of the outermost cylinder, and attached near a bottom of an intermediate cylinder; and ii) at least one intermediate strap, discrete from the first strap, attached near a bottom of the outermost cylinder, and extending through an aperture near a bottom of the intermediate cylinder, around an upper roller near a top of the intermediate cylinder, and attached near a bottom of an inner cylinder; and c) the plurality of straps and the plurality of telescoping cylinders intercoupled in series with alternating strap and cylinder.

16. A telescoping mast apparatus in accordance with claim 15, wherein the plurality of telescoping cylinders, further comprises:

at least one roller, disposed near a top of a cylinder, the roller having a channel with a smaller diameter to receive the strap, and a flange with a larger diameter to bear against an adjacent cylinder.

17. A telescoping mast apparatus in accordance with claim 15, further comprising:

a plurality of annular bearings, each annular bearing substantially circumscribing one of the plurality of telescopic cylinders, bearing against an adjacent cylinder, and aligning the plurality of telescoping cylinders.

18. A telescoping mast apparatus in accordance with claim 15, further comprising:

a plurality of laterally off-set rollers, receiving one of the straps around the rollers, displacing the strap laterally.

19. A telescoping mast apparatus in accordance with claim 18, wherein the plurality of laterally off-set rollers further comprises:

an alignment frame mounted on the base at an angle to the lateral axis of the strap and at an angle to the upward axis of the strap;

a first plurality of rollers disposed in the alignment frame and offset at a relatively smaller angle with respect to the lateral axis of the strap; and a second plurality of rollers disposed in the alignment frame and offset at a relatively larger angle with respect to the lateral axis of the strap.

* * * * *